US005796381A

United States Patent [19]

Iwasaki et al.

[11] Patent Number: 5,796,381

[45] Date of Patent: Aug. 18, 1998

[54] DRIVING METHODS FOR LIQUID CRYSTAL DEVICES AND LIQUID CRYSTAL APPARATUS

[75] Inventors: Manabu Iwasaki, Yokohama; Akira Tsuboyama; Kazunori Katakura, both of Atsugi; Hidemasa Mizutani, Sagamihara, all of Japan

[73] Assignee: Canon Kabushiki Kaisha, Tokyo, Japan

[21] Appl. No.: 534,385

[22] Filed: Sep. 27, 1995

[30] Foreign Application Priority Data

| | | | |
|---|---|---|---|
| Sep. 28, 1994 | [JP] | Japan | 6-259392 |
| Feb. 27, 1995 | [JP] | Japan | 7-061501 |
| Jun. 19, 1995 | [JP] | Japan | 7-152046 |
| Sep. 20, 1995 | [JP] | Japan | 7-241853 |

[51] Int. Cl.[6] ..... G09G 3/36

[52] U.S. Cl. ..... 345/101; 345/94

[58] Field of Search ..... 345/101, 94, 97, 345/87, 95, 96, 208, 209, 210; 349/72, 134, 172

[56] References Cited

U.S. PATENT DOCUMENTS

| | | | |
|---|---|---|---|
| 4,655,561 | 4/1987 | Kanbe et al. . | |
| 4,836,656 | 6/1989 | Mouri et al. . | |
| 4,902,107 | 2/1990 | Tsuboyama et al. . | |
| 5,033,822 | 7/1991 | Ooki et al. . | |
| 5,041,821 | 8/1991 | Onitsuka et al. . | |
| 5,189,536 | 2/1993 | Hanyu et al. . | |
| 5,267,065 | 11/1993 | Taniguchi et al. . | |
| 5,276,542 | 1/1994 | Iwayama et al. | 345/101 |
| 5,283,564 | 2/1994 | Katakura et al. | 345/87 |
| 5,489,918 | 2/1996 | Mosier | 345/101 |

FOREIGN PATENT DOCUMENTS

| | | |
|---|---|---|
| 56-107216 | 8/1981 | Japan . |
| 02281233 | 11/1990 | Japan . |

*Primary Examiner*—Regina Liang

*Attorney, Agent, or Firm*—Fitzpatrick, Cella, Harper & Scinto

[57] ABSTRACT

The waveforms of driving signals used for driving a display device which comprises a smectic liquid crystal and matrix electrodes including scanning electrode groups and information electrode groups are changed according to the ambient temperature in order to provide a satisfactory display in a wide range of temperatures. These types of the driving signals suppress unexpected inversion of the liquid crystal molecules at a low temperature and provide fast scanning at a high temperature.

19 Claims, 14 Drawing Sheets

SCAN SELECTION SIGNAL

SCAN NON-SELECTION SIGNAL

INFORMATION SIGNAL FOR BRIGHT DISPLAY

INFORMATION SIGNAL FOR DARK DISPLAY

DRIVING METHODS FOR LIQUID CRYSTAL DEVICES AND LIQUID CRYSTAL APPARATUS

BACKGROUND OF THE INVENTION

1. Field of the Invention

The present invention relates to driving methods for liquid crystal devices used in optical valves for liquid crystal printers or display apparatuses for displaying characters and images in personal computers and TV receivers, and more particularly, to driving methods for a liquid crystal device suited to a matrix display apparatus which displays with the use of the two stable states of a ferroelectric liquid crystal.

2. Description of the Related Art

A liquid crystal display device in which a liquid crystal compound is filled between the scanning electrode groups and the information electrode groups of a matrix electrode and a number of pixels are formed is well known for displaying image information. Especially, a bistable, ferroelectric liquid crystal device responding quickly to an electric field is expected to function as a high-speed, memory-type display device, and has been proposed, far example, in the Unexamined Japanese Patent Publication No. 56-107216, U.S. Pat. Nos. 4,655,561 and 4,836,656. Many driving methods for matrix-driving this device have also been proposed. Practical driving methods have been disclosed, for example, in the Unexamined Japanese Patent Publication No. 2-281233, and U.S. Pat. No. 5,267,065.

FIGS. 1A–1D show the waveforms of driving signals for a liquid crystal display, such as the waveforms described in U.S. Pat. No. 5,267,065. In these figures, there is shown a scan selection signal A, a scan non-selection signal B, an information signal for bright display C, and an information signal for dark display D. These signals can be used at a temperature below a specific temperature also in this invention as described below. The bright display and dark display are optical states selectively specified with a combination of the alignment state of liquid crystal molecules and a polarizing device.

A conventional ferroelectric liquid crystal display device changes its threshold characteristics as a display device due to the interaction between the substrates and the liquid crystal layer at the interfaces when the device is left for a long period with the liquid crystal molecules being set to a stable condition. Especially at a low temperature, the ferroelectric liquid crystal molecules tend to fluctuate with pulses having amplitudes less than the threshold. In the driving methods disclosed in the Unexamined Japanese Patent Publication No. 2-281233 and U.S. Pat. No. 5,267,065, the information signal C or D shown in FIG. 1 is continuously applied in order to increase the frame frequency. Applying consecutive pulses having a width of $\Delta T$ largely fluctuates the liquid crystal molecules when they are not selected, inverting a part of the display pixels. Satisfactory display may not be maintained.

It has been found that the alignment of liquid crystal molecules tend to be defective at a low temperature, for example, at 20° C. or less. Some ferroelectric liquid crystals have bending smectic layers showing the chevron structure, which has a C1 alignment and a C2 alignment. The C2 alignment may be unexpectedly generated in those liquid crystals, which are expected to show uniform C1 alignment at a low temperature. When molecules having the C2 alignment exist in molecules having the C1 alignment, transmittance cannot be controlled in the molecules having the C2 alignment, reducing the contrast. It has been believed that these problems related to alignment can be solved with a selection or a physical design of materials composing a liquid crystal panel, such as improvements in liquid crystal materials and alignment film. The inventors, however, noticed that the C2 alignment is suppressed and defects decrease when certain driving signals are used, while the inventors tried to solve the display inversion problem (described above) caused by a conventional driving method.

SUMMARY OF THE INVENTION

Accordingly, it is an object of the present invention to provide a driving method for a liquid crystal device, which suppresses unexpected inversion of the liquid crystal molecules at a low temperature and provides fast scanning at a high temperature.

Another object of the present invention is to provide a driving method for a liquid crystal device, which provides a wide range of driving conditions to be selected for obtaining the desired display state.

Still another object of the present invention is to provide a driving method for a liquid crystal device, which suppresses alignment defects in a wide range of temperatures.

Yet another object of the present invention is to provide a driving method for a liquid crystal display, which allows satisfactory display characteristics in a wide range of temperatures.

The foregoing objects are achieved according to this invention through the provision of a driving method for driving a display device having a smectic liquid crystal and matrix electrodes comprising scanning electrode groups and information electrode groups such that the waveforms of driving signals applied to the scanning electrode groups and the information electrode groups are changed according to the temperature.

A driving method may be configured such that an electric field is always applied to the liquid crystal when the display device has a high temperature, and a period in which an electric field is not applied to the liquid crystal is provided when the display device has a low temperature.

A selection period may be changed between when the display device has a high temperature and when the display device has a low temperature.

A driving method may be configured such that, among the driving signals, a scanning selection signal applied to the scanning electrode groups comprises a selection pulse; an erasing pulse disposed immediately before the selection pulse; and an auxiliary pulse disposed immediately after the selection pulse irrespective of the temperature, and an information signal applied to the information electrode groups comprises at a high temperature a selection pulse and auxiliary pulses disposed before and after the selection pulse, and comprises at a low temperature a selection pulse, auxiliary pulses dispose before and after the selection pulse, and a rest period provided between the two auxiliary pulses so as not to continue the auxiliary pulses.

The foregoing objects are also achieved according to this invention through the provision of a display apparatus comprising: a display device; a driver for scanning and driving the device; a controller for controlling the device through the driver; a display-data generator for generating display data; a temperature detector for detecting the temperature; and an external adjuster for externally adjusting driving conditions: and being configured such that the device is driven according to the temperature by referring to detection data obtained by the temperature detector and driving-condition adjustment data controlled by the external adjuster when the controller controls the device based on the display data created by the display-data generator and the driving conditions, wherein the driving conditions the controller uses for controlling include the voltages, scanning periods, and waveforms of driving signals for driving the device, and the external adjuster externally adjusts the driving conditions excluding the waveforms of the driving signals.

The controlling means may refer to detection data obtained by the temperature detector less frequently than the controlling means refers to driving-condition adjustment data controlled by the external adjuster.

The external adjuster may use detection temperature data obtained by the temperature detector with a constant amount of offsets being added, as driving-condition adjustment data.

DETAILED DESCRIPTION OF THE PREFERRED EMBODIMENTS

The present invention features changes in the waveforms of driving signals according to the temperature. The temperature refers to the temperature of the environment in which a liquid crystal device is disposed when operating. In other words, it is temperature data detected by a temperature sensor provided for the liquid crystal device or an apparatus including the device.

The temperature sensor may be disposed at any position as long as the liquid crystal device is satisfactorily driven, such as the surface or end face of the glass substrates of the liquid crystal device, the vicinity of the driving circuit for the device, a place between the backlight and the device, and a case covering or assembling the device. It is preferred that a thermistor is mounted on a glass substrate of the liquid crystal device outside the display section (display screen).

The changing of waveforms does not mean that the driving signals uniformly change their pulse widths, pulse amplitudes (peak values), and scan selection periods. This point will be clearly understood as you read through the specification.

To align a ferroelectric liquid crystal, a pair of glass substrates is generally used on which homogeneous polymer film capable of aligning a liquid crystal molecule in the horizontal direction, such as polyimide (PI) and polyamide (PA), is formed and to which rubbing treatment is applied almost in the same direction.

Figure 2:
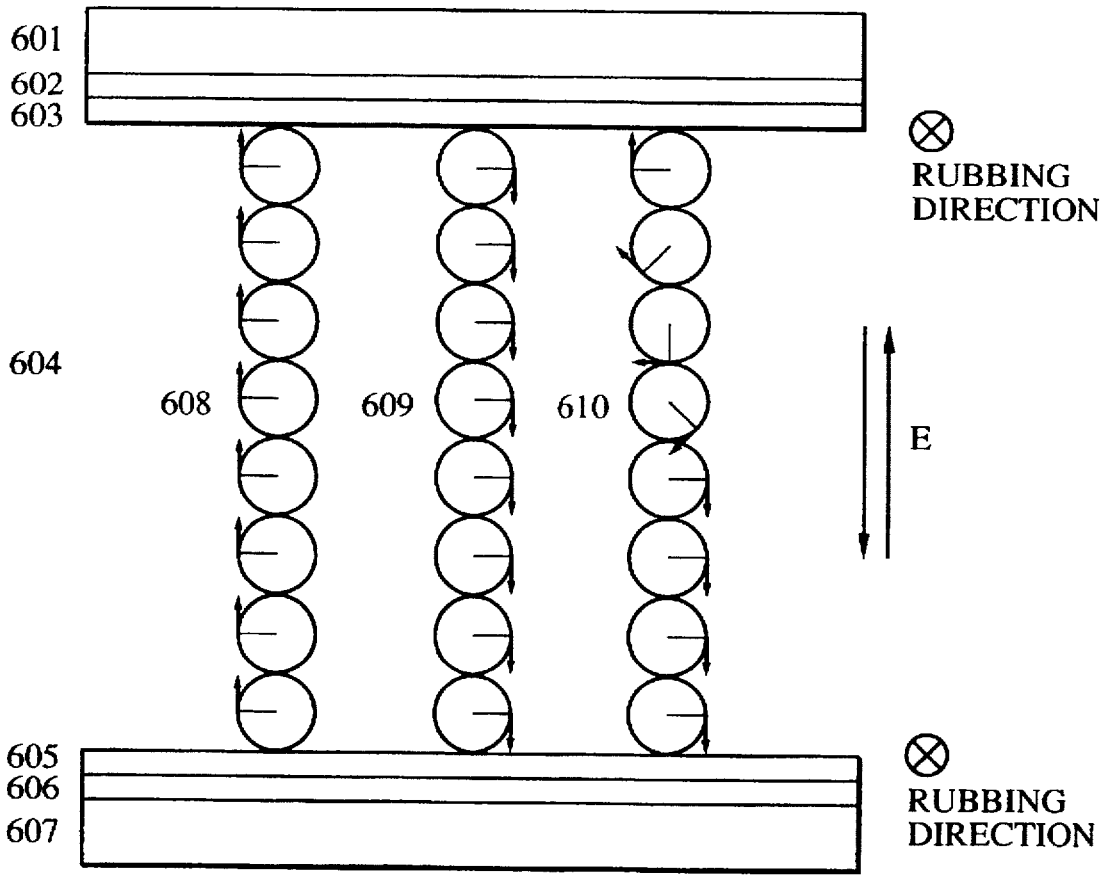
FIG. 2 is a typical view of alignment states of liquid crystal molecules.

FIG. 2 shows an alignment model of a liquid crystal. In FIG. 2, there is shown glass substrates 601 and 607, transparent electrodes 602 and 606, such as ITO, polymer film layers 603 and 605 capable of being a homogeneous structure to which rubbing treatment is applied as uniaxial alignment treatment, and a ferroelectric liquid crystal layer 604. There is also shown cones 608, 609, and 610 viewed from the front which characterize the alignment condition of the liquid crystal molecules at the chiralsmectic phase. The cones 608 and 609 show two stable conditions in the uniform alignment, and the cones 610 shows an example of a splay alignment.

Figure 3:
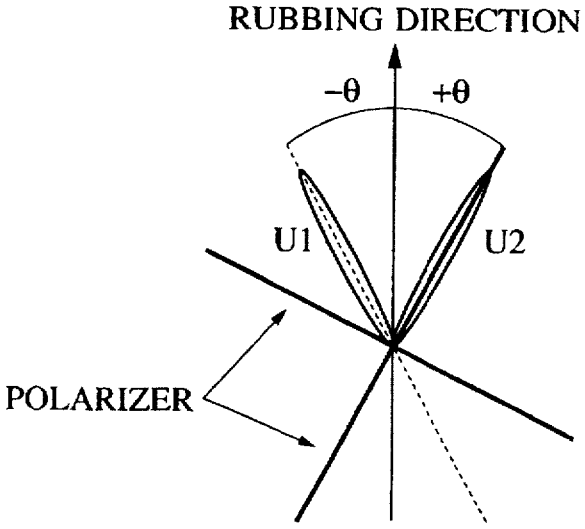
FIG. 3 is a typical view illustrating the relationship between liquid crystal molecules and a polarizer.

Just for the sake of convenience, let the stable state indicated by 608 be called U1, and the stable state indicated by 609 U2. These two stable states U1 and U2 have tilt angles of $-\theta$ and $+\theta$ against the rubbing direction as shown in FIG. 3. The axis of a polarizer is disposed in the direction of $+\theta$ (or $-\theta$) in advance and the liquid crystal is aligned to the either state of U1 and U2 by applying a voltage between the upper and lower electrodes. Then, the display appears dark or bright.

In other words, in order to make this ferroelectric liquid crystal have the desired electro-optical characteristics, the liquid crystal disposed between the substrates is required to have the alignment state which allows stable and repeatable switching between two stable states and the alignment state must be uniform in a pixel or the whole display screen.

In a display device using a conventional ferroelectric liquid crystal, its threshold characteristics as a display device may change due to mutual operation between the substrates and the liquid crystal layer at the interfaces when the crystal is left for a long period at one stable condition, as described above. Especially at a low temperature, the ferroelectric liquid crystal molecules tend to fluctuate against pulses having amplitude below the threshold.

Figures 1A, 1B, 1C, 1D:
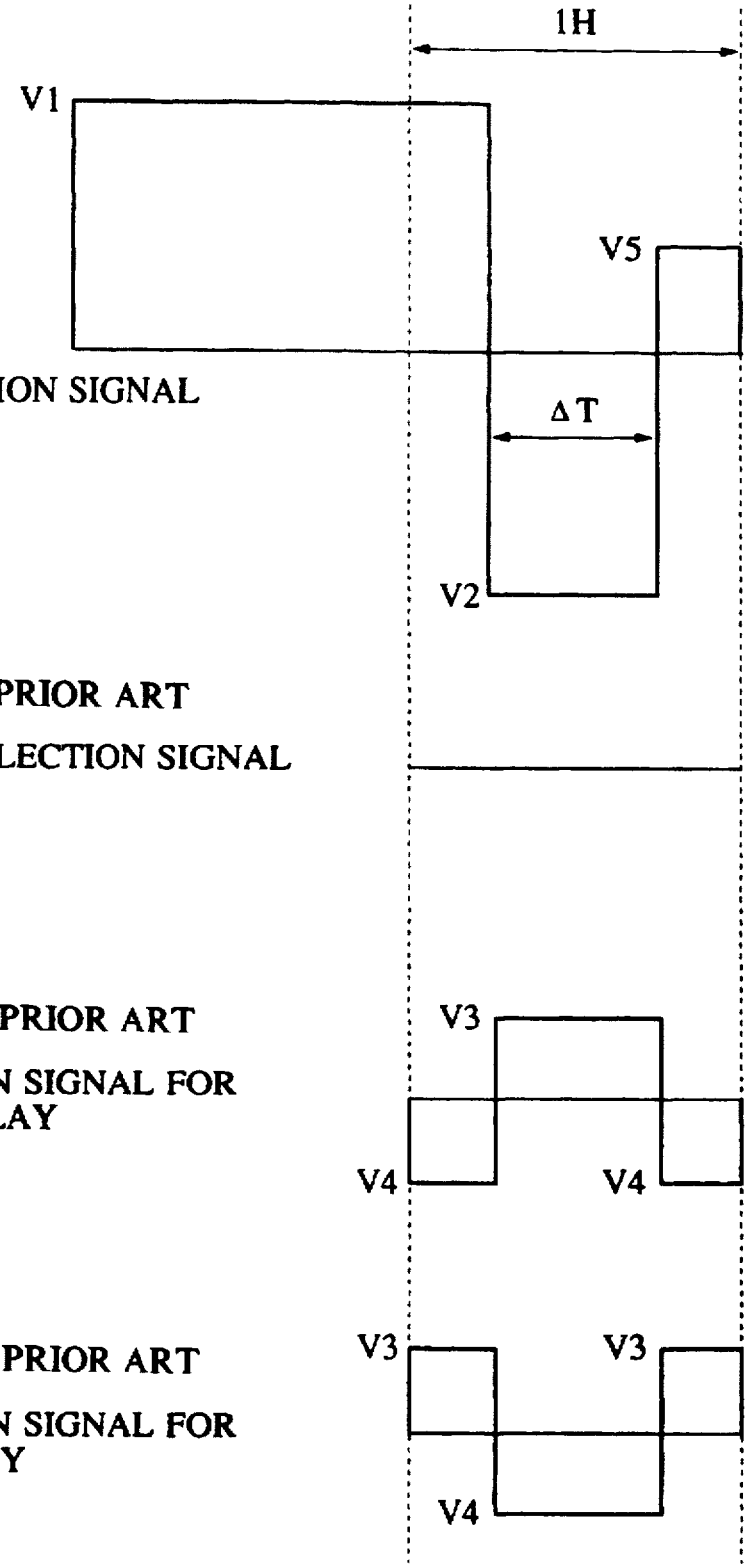
FIG. 1A PRIOR ART
FIG. 1B PRIOR ART
FIG. 1C PRIOR ART
FIG. 1D PRIOR ART
FIGS. 1A–1D show driving signals used for a liquid crystal device.

With the method which always applies a voltage using the information signals C and D shown in FIG. 1, when successive pulses having a width of $\Delta T$ are applied, the liquid crystal molecules fluctuate substantially during the scan non-selection period. This can cause a case in which satisfactory display is not maintained because part of the pixels are inverted.

Embodiments which will be described below assures the range (drive margin) of driving conditions enabling satisfactory display and enables the frame frequency to be increased.

The waveforms of driving signals suited to these embodiments at a certain temperature has a rest period in one horizontal scanning period of an information signal in order to multiplex-drive a liquid crystal device having matrix electrodes. In the rest period, since the potential of an information electrode is the same as that of scanning electrodes not selected, an electric field of zero is applied to the liquid crystal device of the selected pixels.

Figure 4A:
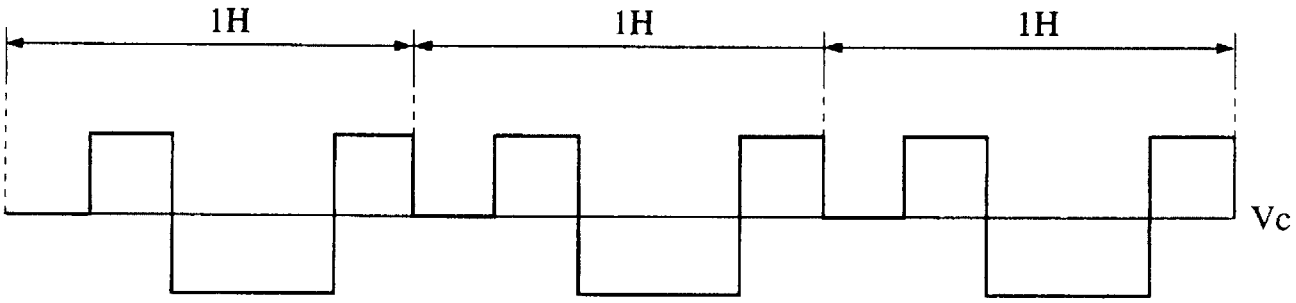
FIGS. 4A–4C show ac pulses.
Figure 4B:
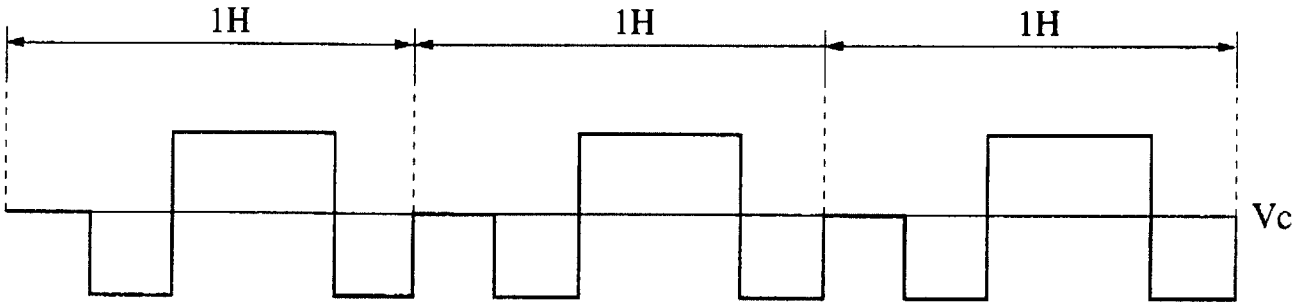
Figure 4C:
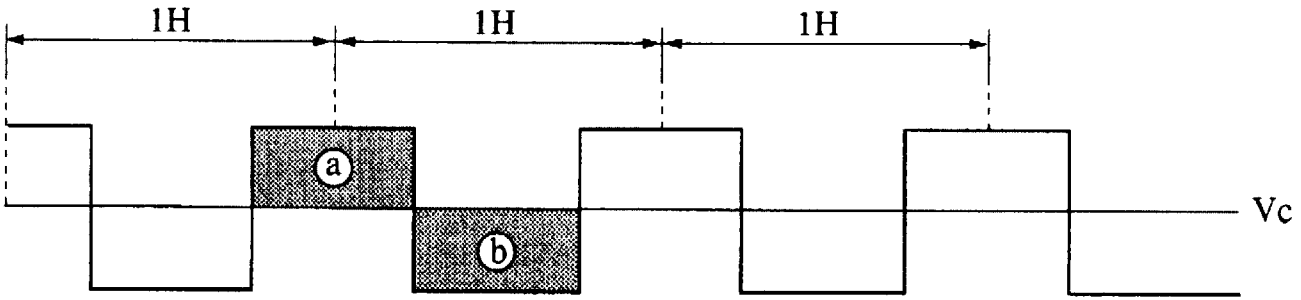
Figure 5A:
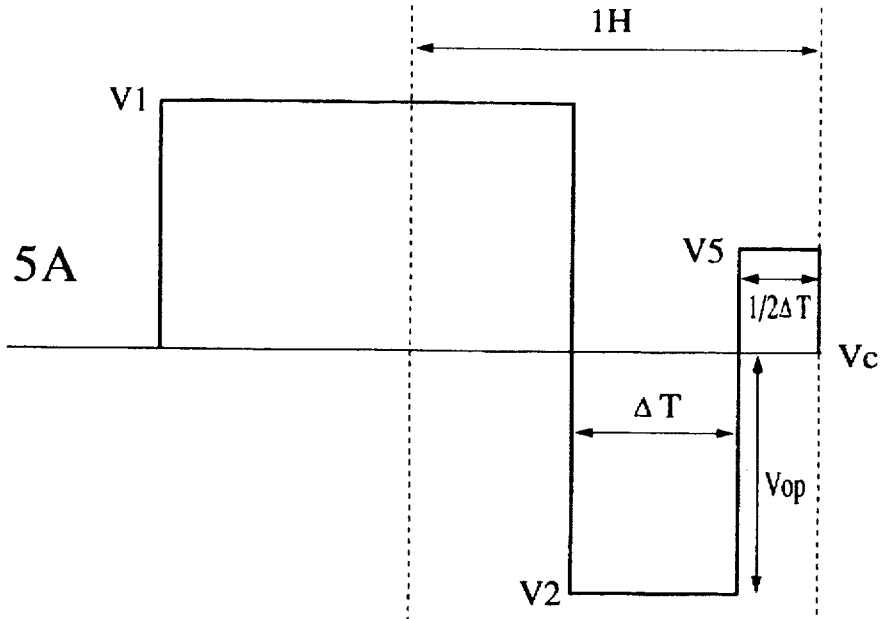
FIGS. 5A–5D show an example of driving signals used in the present invention.
Figure 5B:
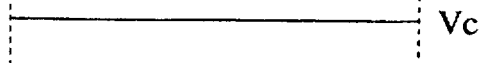
Figure 5C:
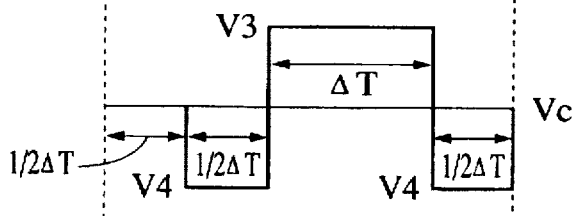
Figure 5D:
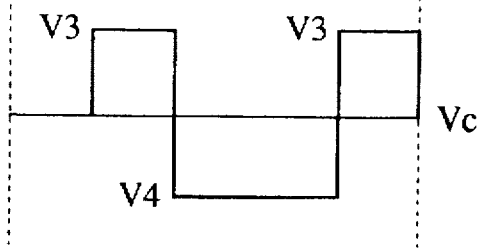

FIGS. 4A–4C show the waveforms of information signals A and B used in these embodiments. There is shown the waveform of an information signal C having no reset period, for comparison.

In an experiment for the relationship between an ac pulse for driving a liquid crystal device and the fluctuation of the liquid crystal, the authors found that when the ac pulse changes its waveform at a non-selection period the degree of the fluctuation of liquid crystal molecules also changes. It can be considered that the signal C is an ac signal alternating between a positive pulse a having a width of ΔT and a negative pulse b having a width of ΔT, the signal A is the signal C in which the pulse a is divided into two sections and a rest period shorter than ΔT is provided between the sections, and the signal B is the signal C in which the pulse b is divided into two sections and a rest period shorter than ΔT is provided between the sections. These three signals have the same effective value. When each of these signals is applied to a liquid crystal device, the liquid crystal molecule changes its fluctuation degree. Under a condition in which a polarity inverting the U1 state to the U2 state shown in FIG. 2 is regarded as a negative, it is found that the molecules substantially fluctuates in the U1 state with the pulse b and the molecules substantially fluctuates in the U2 state with the pulse a.

Regarding a horizontal scanning period as a unit period, the signals A and B have a rest period at the beginning of each horizontal scanning period at a reference voltage of $V_c$. By contrast, the signal C has the same polarity at the end of one horizontal scanning period and the beginning of the next horizontal scanning period successively, causing undesirable inversion.

FIGS. 5A–5D show the waveforms of driving signals A, B, C, and D used in the embodiments; a scan selection signal A, a scan non-selection signal B, an information signal C for indicating a bright state together with a polarizer device, an information signal D for indicating a dark state together with a polarizer. The voltage of a scanning electrode not selected is indicated as a reference voltage of $V_c$. The symbol 1H stands for one horizontal scanning period. When a period required for selecting all n scanning electrodes is called one frame scanning period, 1F, the following expression is satisfied:

$$1F=1H\times n.$$

Fluctuation will be again considered below. When an information signal has a rest period having a width of ΔT/2, shorter than ΔT, as shown in FIGS. 5A–5D show, if a signal created by combining the signals B and D shown in FIGS. 5B and 5D continues, a pulse component such as the pulse b shown in FIG. 4C is not applied. In other words, when another pixel displaying the U1 state on the same information electrode exists, the number of times the pulse b is applied decreases by one per frame. When two other pixels displaying the U1 state exist, the number of times the pulse b is applied decreases by two. When three other pixels displaying the U1 state exist, the number is reduced by three. When all pixels display the U1 state, the pulse b is not applied at all, and a signal having the same waveform as the signal B shown in FIG. 4B is used. The number of times the pulse b is applied considerably decreases compared with the conventional case although it depends on a display pattern. In the same way, the number of times a pulse component such as the pulse a shown in FIG. 4C is applied to pixels having the U2 state is considerably reduced. Therefore, the fluctuation, which conventionally restricts the drive margin, is suppressed, enabling the drive margin to be extended.

Figure 6:
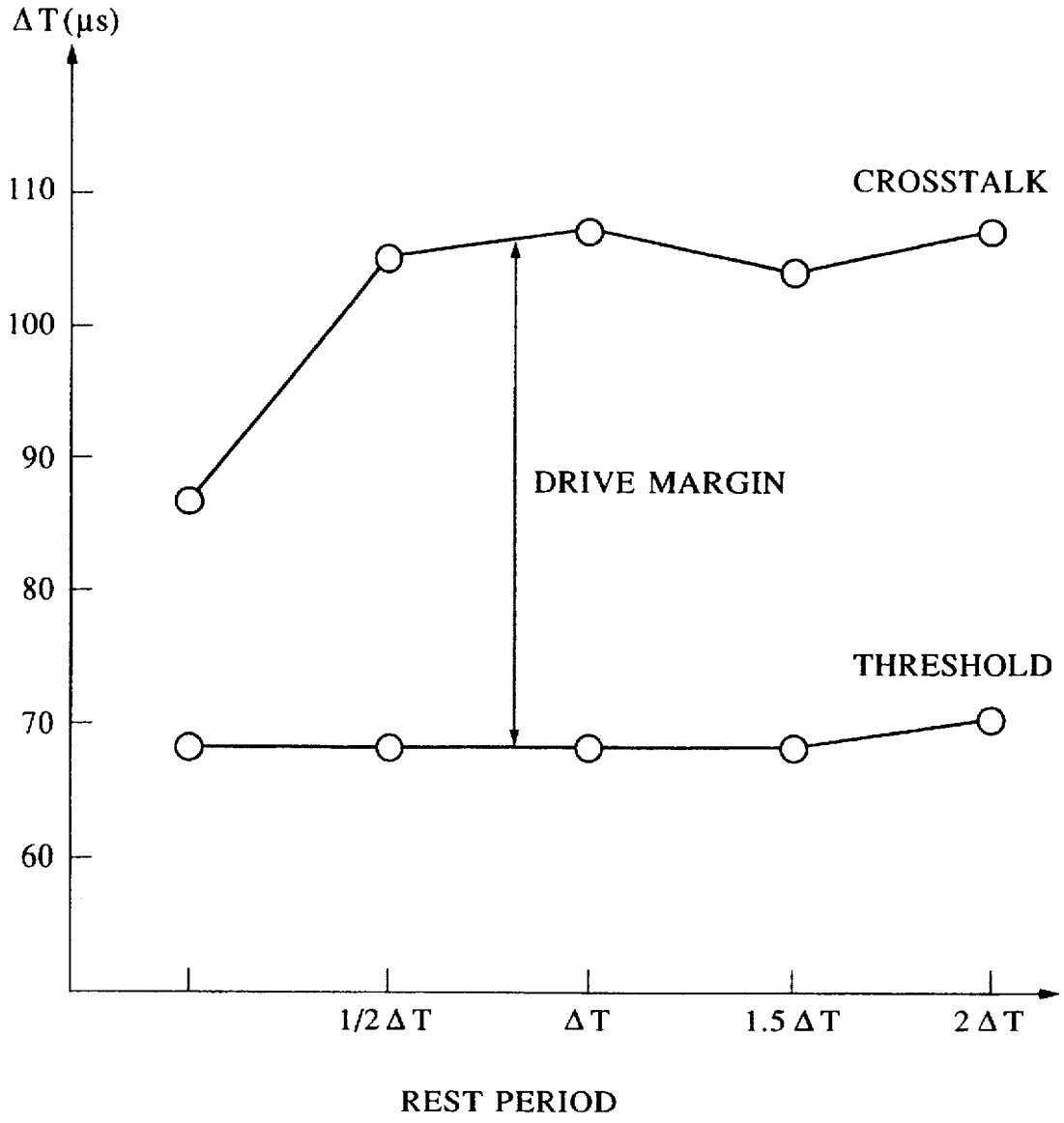
FIG. 6 shows the relationship between a rest period and a drive margin.

The inventors changed the length of a rest period by a multiple of ΔT/2 to check the relationship between the rest period and the drive margin. As a result, it was found that the drive margin is saturated when the rest period has a width of about ΔT/2 as shown in FIG. 6. This measurement was performed at 10° C. with the driving conditions of $V_1$=14.3 V, $V_2$=−14.3 V, $V_3$=5.7 V, $V_4$=−5.7 V, and $V_5$=6.4 V in the range in which satisfactory display can be obtained. To increase the frame frequency, it is better to use a not-very-long rest period. It is preferred that the rest period is longer than ΔT/4 and shorter than ΔT. In terms of the margin and speed, it is suited to set the rest period to ΔT/2. When the rest period is set to a value shorter than ΔT/2, it is desirable that the ratio between the rest period and the width of each pulse is a small integer. This is because the reference clock of a driving circuit system is set in order to output driving signals such that the widths of a selection pulse $V_2$ and an auxiliary pulse $V_5$ are multiples of the rest period in one horizontal scanning period. If the ratio becomes complicated, the clock have to be very fast. As a result, it is required to create a circuit with higher response speed than needed, increasing the cost.

According to the present invention, the number of times pulses which cause substantial fluctuation in the U1 and U2 states are applied is reduced by placing the pulses in the rest period having a width of ΔT/2, assuring the drive margin, increasing the frame frequency, and simplifying the drive circuit.

Figure 7:
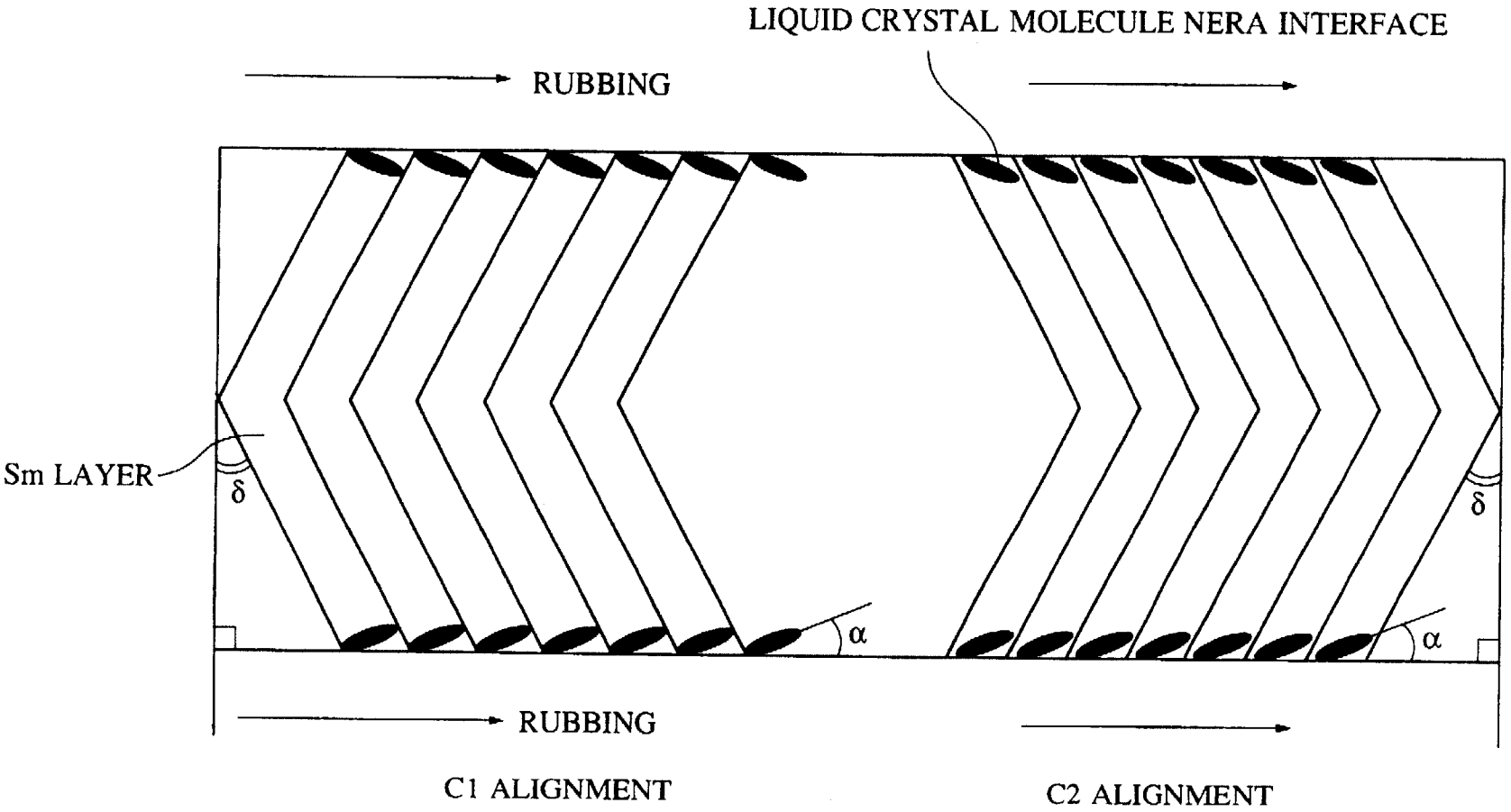
FIG. 7 is a typical view of the C1 and C2 alignments in a chevron structure.

Alignment defects which can be solved with the driving methods of the present invention will be described below by referring to FIG. 7. A ferroelectric liquid crystal is generally a chiralsmectic liquid crystal having a chiralsmectic C phase (SmC*) or an H phase (SmH*) at a specific temperature range. In a cross section of such a ferroelectric liquid crystal device, the layer structure of the chiralsmectic liquid crystal may be a chevron structure, as shown in FIG. 7. The chevron layer has a C1 alignment structure and a C2 alignment structure at random. If these structures mix, the structures have different switching characteristics and alignment defects occur at the boundary of the structures, reducing the contrast and the drive margin, and deteriorating image quality. To prevent this mixture of the alignment structures, the two substrates are rubbed in parallel in the same direction and the pretilt is controlled. Uniform alignment can be obtained (this method is described in Ferroelectrics, pp. 283–294, vol 149, 1993).

With the foregoing method, uniform alignment sufficient for initial use can be obtained. The alignment is uniform with no electric field applied. However, when conventional driving signals shown in FIG. 1 are applied to display the desired image, the two alignment structures described above appear in a mixed condition at a low temperature.

Stable, not-twisted, uniform alignment of liquid crystal molecules are required in the direction normal to the substrates in order to obtain high contrast on a ferroelectric liquid crystal. The C1 alignment shown in FIG. 7 is preferred to do that. The C1 alignment can be obtained by selecting cells and material property parameters that satisfy the following expression (described in U.S. Pat. No. 5,189,536), which disables the C2 state, in terms of geometrical consideration of the structure parameters of a ferroelectric liquid crystal:

$$\Theta<\alpha+\delta \quad (1)$$

where Θ is the tilt angle of the liquid crystal molecule, α is a pre-tilt angle, and δ is the layer inclination angle.

Even when a liquid crystal is created with the condition described above and a stable C1 structure is obtained at the initial stage, if driving signals are applied, the C2 structure may appear at points in the C1 structure, causing point defects on the screen, as described before.

This problem becomes remarkable at a low temperature because the layer inclination angle 6 of the smectic layer against the line normal to the substrates, which features the chevron structure in the chiralsmectic liquid crystal, decreases as the temperature lowers from a room temperature.

Figure 8:
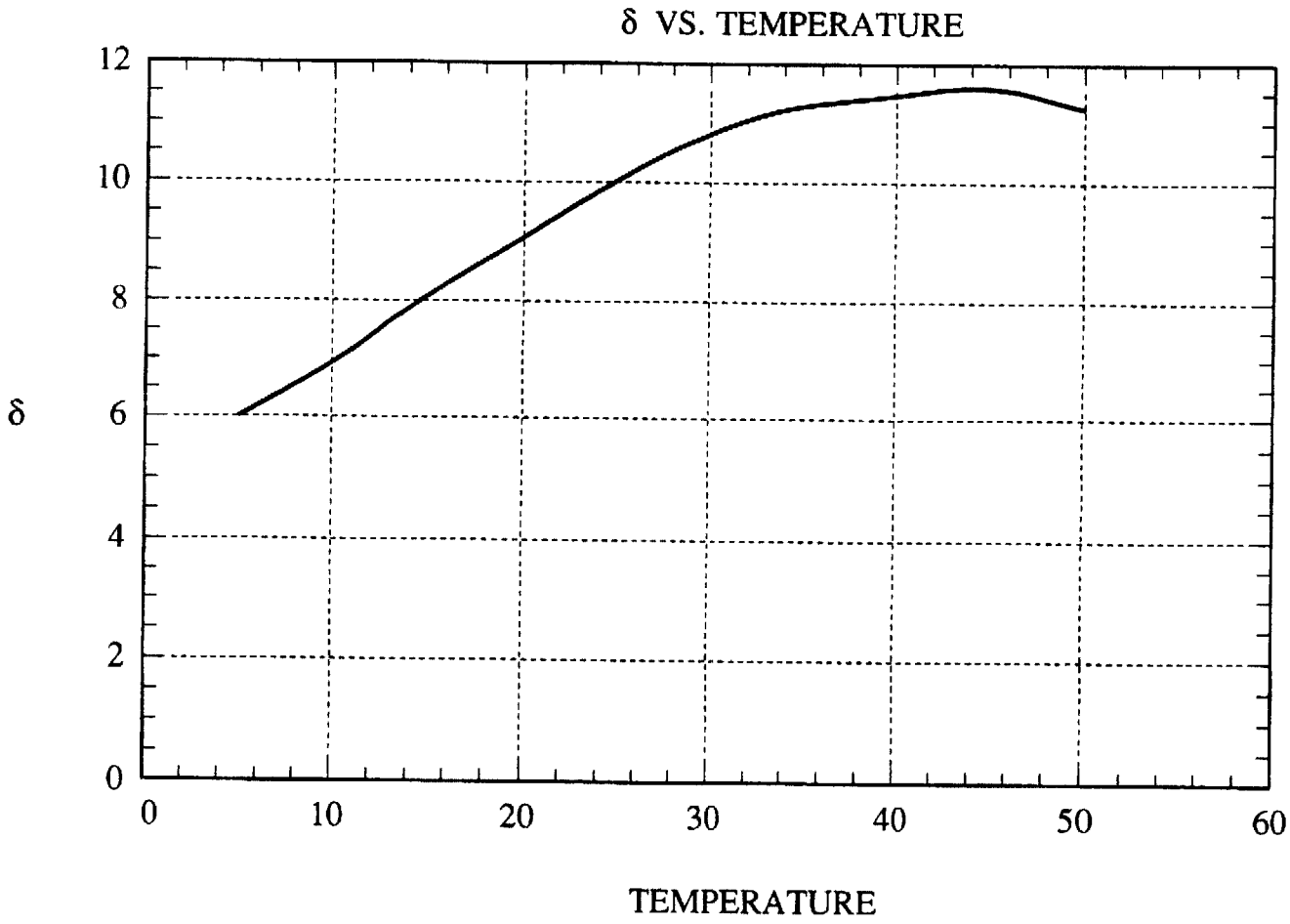
FIG. 8 shows the temperature characteristics of a liquid crystal material used in the present invention.

FIG. 8 shows the relationship between the layer inclination angle δ and the temperature. The liquid crystal composition used for this measurement has the following properties at 30° C. and pre-tilt angle.

Pre-tilt angle: 18 degrees

Tilt angle: 13 degrees

Layer inclination angle: 11 degrees

Phase transition temperature: Iso 92° C. Ch 85° C. SmA 67° C. SmC −17° C. Crystal (temperature lowering process)

This composition is a liquid crystal compound having phenylpyrimidine as the main component, combined with a fluorine compound serving as a chiral additive.

It is thought that why the C2 structure appears when driving signals are applied is that the expression (1) is not satisfied due to a small pre-tilt angle during actual driving because liquid crystal molecules disposed near the interfaces having a pre-tilt angle α specified in alignment treatment receives torque which makes the molecules parallel to the interfaces by interaction of the continuous driving signals and spontaneous polarization.

The inventors found that the occurrence of the C2 structure can be suppressed by providing a rest period in which no electric field is applied to a liquid crystal for driving signals while searching for means for suppressing the occurrence. Proving the rest period releases the torque which reduces a pre-tilt angle and practically increases a pre-tilt angle during driving. Then the expression (1) is satisfied.

It is supposed that why the C2 structure tends to appear at a low temperature is that the energy required for transition between the C1 and C2 structures becomes small because the layer inclination angle δ becomes small as the temperature goes lower. Therefore, if the temperature detected by a temperature sensor does not reach a specified temperature (low temperature condition), it is preferred that a liquid crystal device is driven with driving signals including information signals having the rest period described above. When the temperature detected by the temperature sensor reaches a specified temperature or exceeds it (high temperature condition), it is preferred that the driving signals having different waveforms shown in FIG. 1 are used.

In addition to switching the two types of the driving signals at a boundary of a specific temperature, (n+1) types of driving signals may be switched at borders of at least n boundary temperatures. When the driving signals change from those shown in FIG. 1 to FIG. 5, the rest period may be gradually extended from zero to ΔT/2 intermittently or successively at a temperature area having a specified width.

Not only the waveforms of the driving signals but also at least one of a driving voltage $V_{op}$ used for writing a scan selection signal and one horizontal scanning period 1H can be changed according to the temperature condition in the embodiments of the present invention. This extends the drive margin and suppresses the occurrence of alignment defects further.

Figure 9:
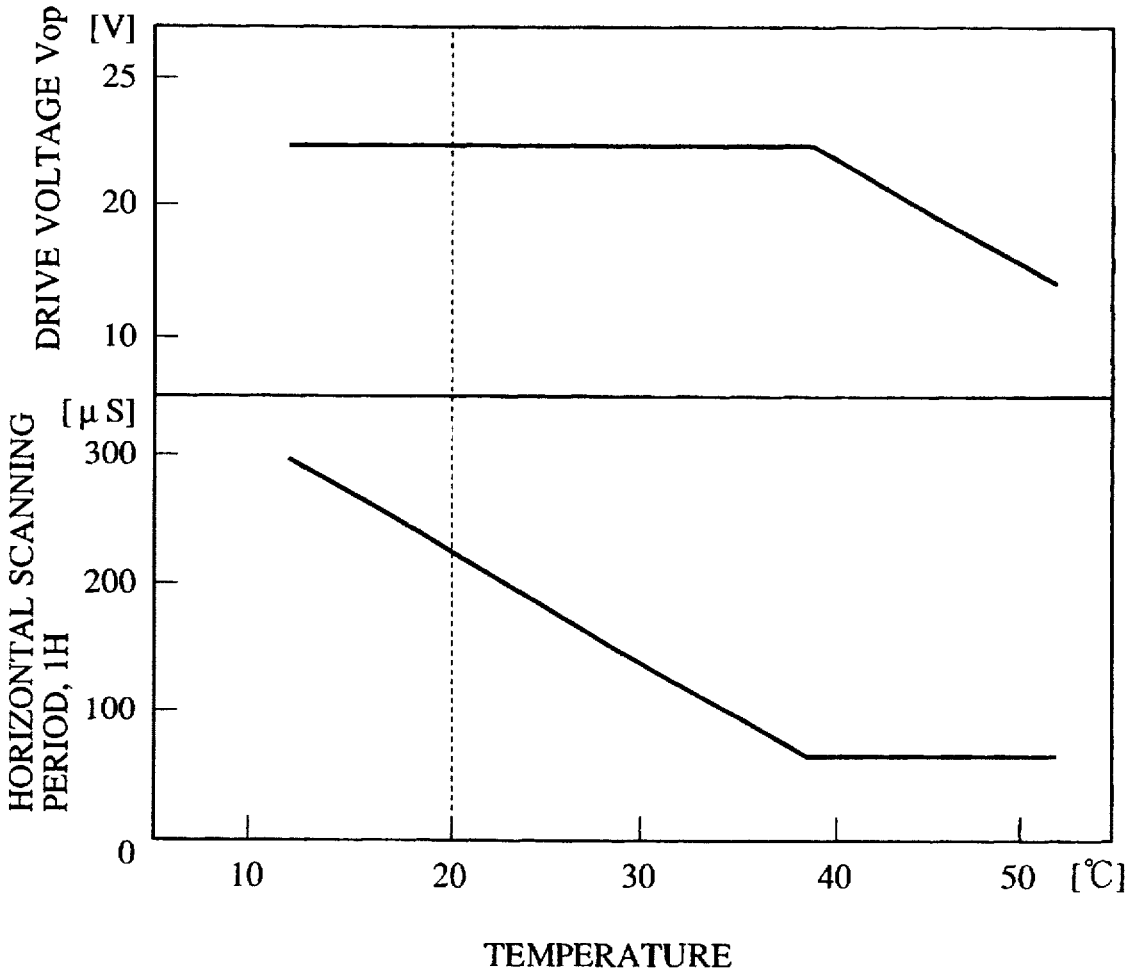
FIG. 9 shows the relationship between driving signals used for the present invention and the temperature.

FIG. 9 shows the relationships of the temperature $T_{mp}$ versus the driving voltage $V_{op}$ and the temperature $T_{mp}$ versus one horizontal scanning period 1H in an embodiment. These relationships are stored in memory, such as RAM or ROM, as a temperature compensation table and the driving voltage $V_{op}$ and one horizontal scanning period 1H corresponding to a detected temperature are read from the memory to drive a liquid crystal device based on the read values. When $V_{op}$ becomes larger and 1H becomes shorter, the number of times information signal pulses having both polarities switch increases. Then, the current flowing through the liquid crystal becomes high, causing heat. Since the heat further increases differences in temperature on the display panel, it is preferred to use driving methods other than that causing the heat.

Figure 10:
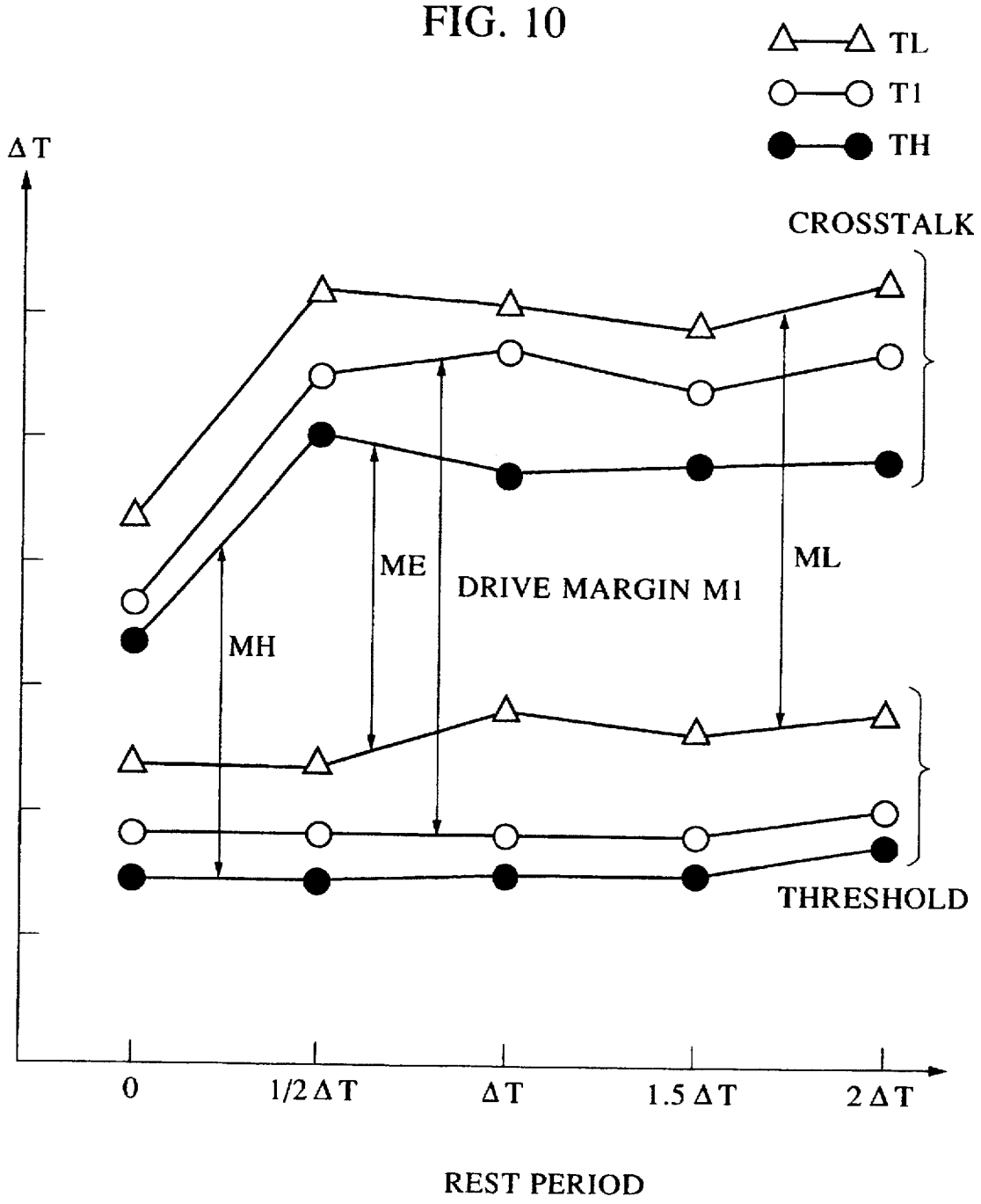
FIG. 10 shows the relationship between a rest period and the temperature and that between a drive margin and the temperature.

FIG. 10 shows an example of the relationship between a drive margin and the temperature. The horizontal axis indicates the rest period of an information signal. The vertical axis indicates the width ΔT of a writing pulse at scan selection. The upper curves exhibit pulse widths at which crosstalk starts appearing in pixels on not-selected scanning lines. The lower curves exhibit pulse widths (thresholds) at which pixels on selected scanning lines can be inverted. The periods between these curves are drive margins M1 at an intermediate temperature, ML at a low temperature, MH at a high temperature, and ME for satisfactory display at a wide temperature range from low to high temperatures.

As described before, the margin ME can be extended with the use of a temperature compensation table such as that shown in FIG. 9. A wide margin can be obtained with the use of the temperature compensation table shown in FIG. 9 with a rest period being set in the range from ΔT/4 (inclusive) to less than ΔT, more preferably, in the range from ΔT/4 to 3ΔT/4 (both inclusive).

A scanning method used in the driving methods of the present invention will be described below.

Figure 11:
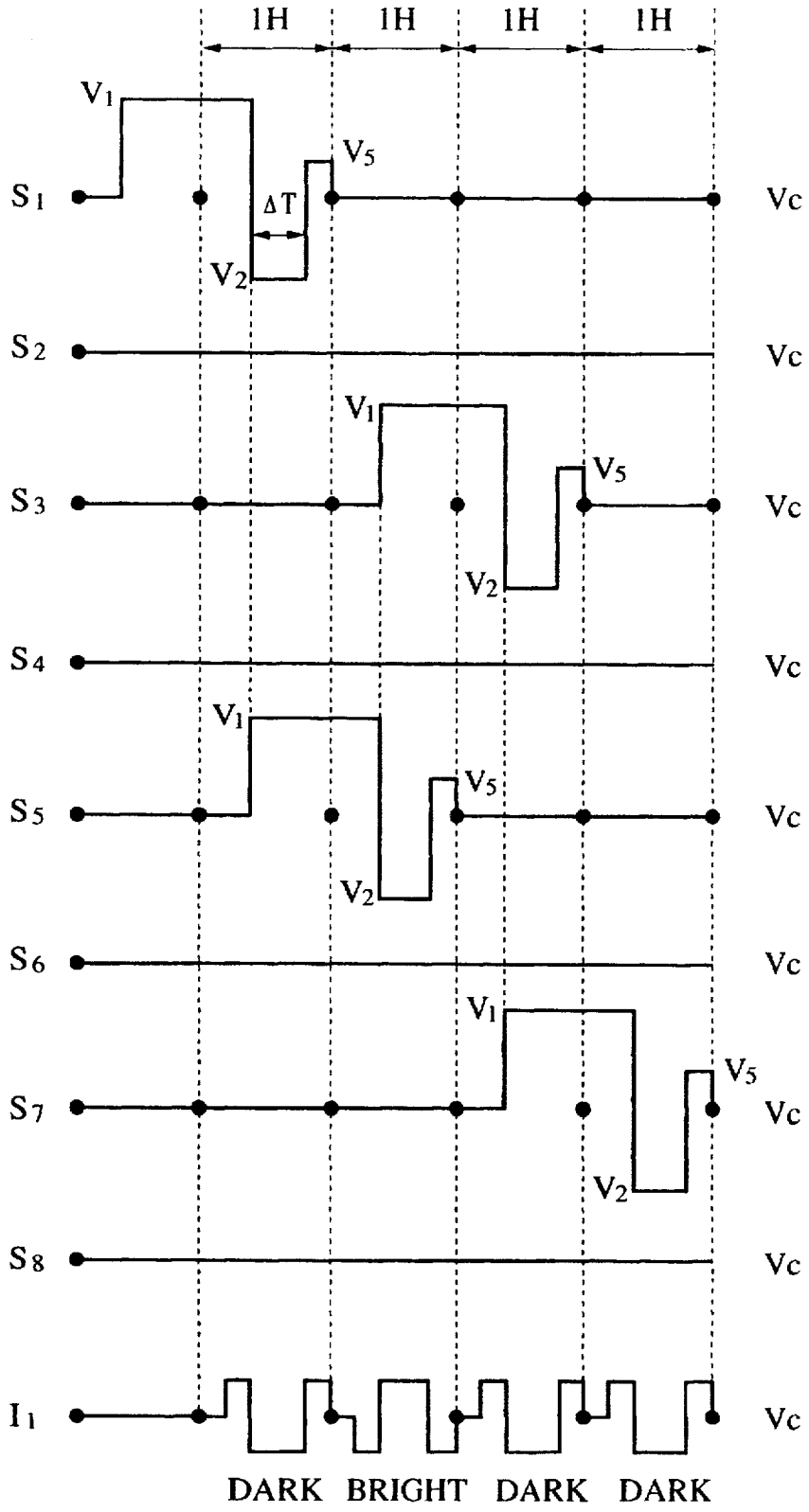
FIG. 11 shows scanning signals and an information signal used in the present invention.

FIG. 11 illustrates an example of the scanning method. Signals $S_1$ to $S_8$ are applied to scanning electrodes. A signal $I_1$ is applied to an information electrode. The signals shown in FIG. 11 are used at a low temperature whereas the information signals shown in FIG. 1 are used at a high temperature.

The simplest scanning method with eight scanning electrodes is the noninterlaced method, in which a screen is scanned every line with the signals $S_1$, $S_2$, $S_3$, . . . $S_7$, and $S_8$ in that order. Another scanning method is the interlace method, in which a screen is scanned every other lines with the signals $S_1$, $S_3$, $S_5$, $S_7$, $S_2$, $S_4$, $S_6$, and $S_8$ in that order.

FIG. 11 indicates a multi-interlace method, in which a screen is scanned with the signals $S_1$, $S_5$, $S_3$, $S_7$, $S_2$, $S_6$, $S_4$, and $S_8$ in that order to suppress flicker.

The rest period synchronizes with a reset pulse (erasing pulse) and has a width of ΔT/2 synchronizing with the ΔT/2 period immediately after the auxiliary pulse $V_5$.

To display a still image or dynamic image (moving pictures) changing on the whole screen, it is suited to repeat refresh scanning in the multi-interlace method. More preferably, when only a part of the screen is rewritten in a case such as for moving a mouse cursor, scrolling a window, and inputting characters to a window, the non-interlaced method is used for scanning lines corresponding to images to be rewritten and the interlace or multi-interlace method is used for the other scanning lines. A deletion pulse having a voltage $V_1$ should be set such that its width is larger than the selection pulse width ΔT and the pulse rises before the start of the period 1H in which the corresponding scanning electrode is selected.

The timing when a selection pulse $V_2$ is applied to a m-th selected scanning electrode may coincide with or may follow the timing when the erasing (reset) pulse $V_1$ is applied to (m+1)-th selected scanning electrode.

Figure 12:
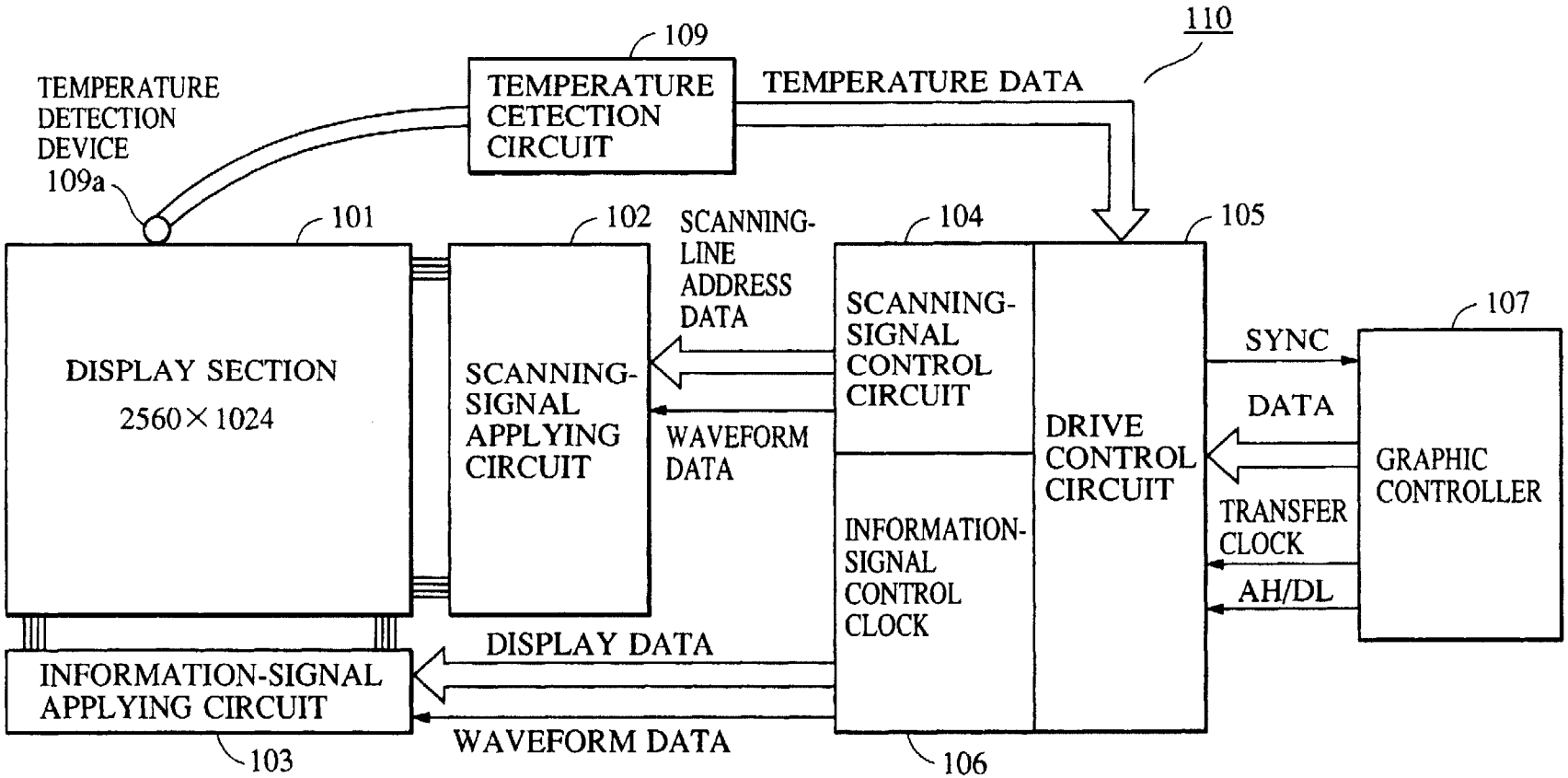
FIG. 12 is a block diagram of a display apparatus using a liquid crystal device according to the present invention.

FIG. 12 is a block diagram of a display apparatus using a liquid crystal device according to an embodiment of the present invention. A graphic controller 107 outputs data to a scanning signal control circuit 104 and an information signal control circuit 106 through a drive control circuit 105, and the data is converted to address data and display data. According to this address data, a scanning signal applying circuit 102 generates a scan selection signal and a scan non-selection signal and applies them to the scanning electrodes of a display section 101 including pixels of 1280 by 1024. An information signal applying circuit 103 generates an information signal according to the display data, and applies it to the information electrodes of the display section 101. A temperature detection circuit 109 includes a comparator which compares the reference voltage with the voltage output from a temperature detection device 109*a*.

Figure 13:
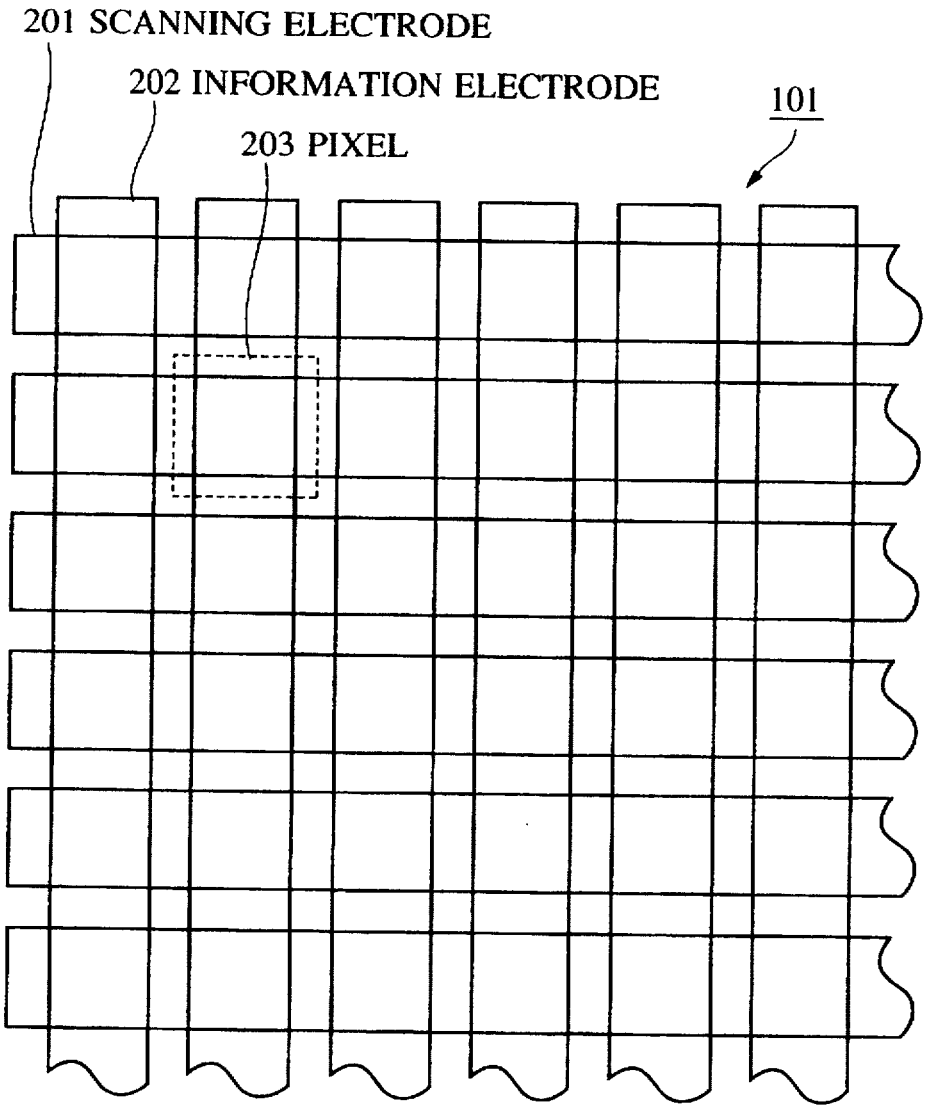
FIG. 13 illustrates pixels of the liquid crystal device.

FIG. 13 is a partial enlarged view of the display section 101, which is a liquid crystal device. In FIG. 13, a pixel 203 is composed of the intersection of a scanning electrode 201 and an information electrode 202, and serves as a display unit.

Figure 14:
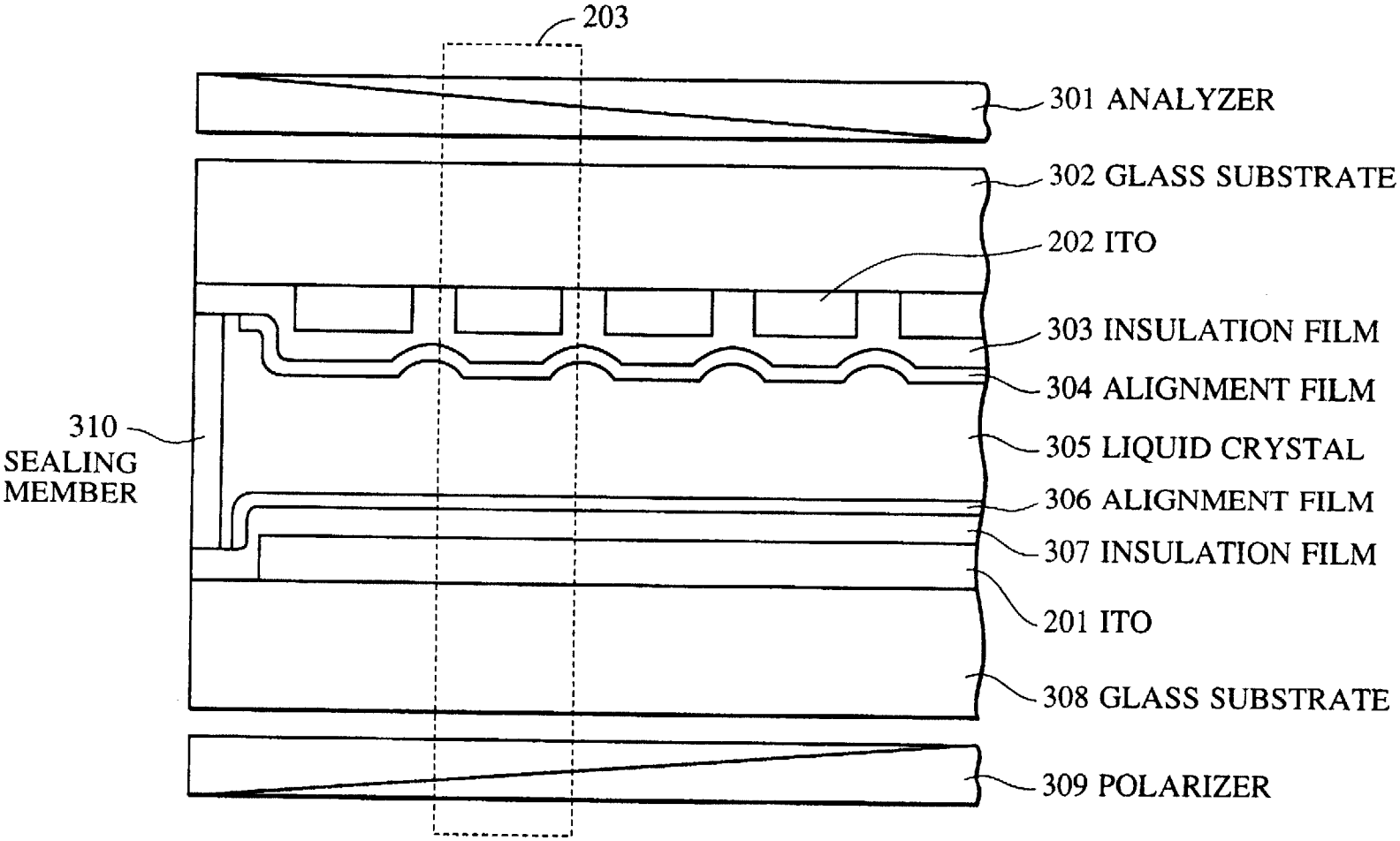
FIG. 14 is a typical cross section of the display section.

FIG. 14 is a partial cross section of the display section 101. In FIG. 14, an analyzer 301 serving as a polarizing device and a polarizer 309 serving as a polarizing device are disposed crosswise with each other such that the display section 101 is dark in the U2 state. There is also shown glass substrates 302 and 308, insulation film 303 and 307, alignment film 304 and 306, a ferroelectric liquid crystal 305, and a sealing member 310.

To make a reflection-type liquid crystal device, neither one substrate nor one electrode glass is required to be transparent, unlike ITO.

It is preferred that a liquid crystal material having a relatively large pre-tilt angle and presenting a chevron structure with the C1 alignment in a combination with alignment film be used in the present invention. One of such materials is a liquid crystal compound having phenylpyrimidine as the main component, combined with a fluorine compound serving as a chiral additive. As alignment film, inorganic matter such as oblique-evaporated SiO or organic matter such as polyimide can be used. To set the pre-tilt angle to 10 degrees or more, it is preferable to use filmed fluorine polyimide to which rubbing treatment is applied. The rubbing treatment is performed in the same direction on both substrates. The rubbing direction on one substrate preferably intersects that on the other substrate with a small angle. This type of rubbing treatment is called cross-rubbing.

Liquid crystal molecules in a high pre-tilt alignment at a pre-tilt angle of 10 degrees may move along the inner surfaces of the substrates when a voltage is applied to the molecules. The driving method of the present invention may suppress this phenomenon. It is known as another method that forming minute protruded portions on alignment film suppresses the movement of liquid crystal molecules. In this case, alignment defects may occur in the protruded portions. These alignment defects will be able to be further suppressed by the use of the driving method of the present invention.

(First embodiment)

A first embodiment of the present invention uses the display apparatus shown in FIG. 12. The graphic controller 107 outputs data to the scanning signal control circuit 104 and the information signal control circuit 106 through the drive control circuit 105, and the data is converted to address data and display data. According to this address data, the scanning signal applying circuit 102 generates the scan selection signal A shown in FIG. 1 and that shown in FIG. 5, and the scan non-selection signal B shown in FIG. 1 and that shown in FIG. 5, and applies them to the scanning electrodes of the display device 101 including pixels of 1280 by 1024. The information signal applying circuit 103 generates information signals C and D shown in FIG. 1 and those shown in FIG. 5 according to the display data, and applies them to the information electrodes of the display device 101.

The temperature of the display device 101 is input to the temperature detection circuit 109 through the temperature detection device 109*a*. According to this temperature, the drive circuit 105 selects the drive signal to be used and sends it to the scanning signal applying circuit 102 and the information signal applying circuit 103 through the scanning signal control circuit 104 and the information signal control circuit 106, respectively.

A drive control circuit 110 according to the embodiment of the present invention comprises the scanning signal applying circuit 102, the information signal applying circuit 103, the scanning signal control circuit 104, the drive circuit 105, and the temperature detection circuit 109.

A type of the phenylpyrimidine ferroelectric liquid crystal described before having the properties shown in Table 1 below is used.

TABLE 1

| | | | | |
|---|---|---|---|---|
| | $P_s$ | | 6.1 nC/cm$^2$ (30° C.) | |
| | Tilt angle | | 14.6° (30° C.) | |
| | $\Delta\epsilon$ | | −0.2 (30° C.) | |
| | 91.5° C. | 85.0° C. | 66.7° C. | −16.7° C. |
| | → | → | → | → |
| $I_{so}$ | Ch | SmA | SmC* | Crystal |
| | ← | ← | ← | ← |
| | 91.8° C. | 85.7° C. | | −12.5° C. |

When the pixels used in this embodiment are divided into three groups and appropriate color filters are disposed on the groups, the apparatus can be used as a multi-color display apparatus.

The display apparatus of this embodiment allows satisfactory display on the whole screen of the display device 101 at 35° C., which is a high temperature, with the driving signals shown in FIG. 1 under the conditions of $V_1$=14.3 V, $V_2$=−14.3 V, $V_3$=5.7 V, $V_4$=−5.7 V, $V_5$=6.4 V, and $\Delta T$=32 μs. The horizontal scanning period is as short as 65 μs.

The display apparatus of this embodiment allows satisfactory display on the whole screen of the display device 101 at 10° C., which is a low temperature, with the driving signals shown in FIG. 5 under the conditions of $V_1$=14.3 V, $V_2$=−14.3 V, $V_3$=5.7 V, $V_4$=−5.7 V, $V_5$=6.4 V, and $\Delta T$=80 μs.

Table 2 indicates relative differences in display quality between the displays driven by the driving signals shown in FIG. 1 (W1) and those shown in FIG. 5 (W2).

TABLE 2

| | Low temperature | | Room & high temp. | |
|---|---|---|---|---|
| Driving signals | Margin | Speed | Margin | Speed |
| W1 | C | A | A | A |
| W2 | A | B | A | B |

A: Superior,
B: average,
C: slightly inferior

This embodiment selects the driving signals corresponding to the sections enclosed in the thick lines in Table 2. With the temperature boundary between low and high temperature ranges being set to 15° C., at which the driving signals are switched, a satisfactory display is always assured and high-speed display is enabled at a high temperature.

In this embodiment, the waveforms of the driving signals are changed as the temperature changes. The rest period is eliminated at room and high temperatures to increase the frame frequency and the rest period is inserted at a low temperature to suppress the number of times the pulses which substantially affect the U1 and U2 states are applied, thereby assuring the drive margin.

(Second embodiment)

Since the range of temperature compensation for a display device is limited with only two driving conditions, the drive voltage $V_{op}$ and the horizontal scanning period, the waveforms of driving signals, such as a scanning signal writing pulse and an information signal, are added to the driving conditions and the waveforms are changed for temperature compensation by referring to the display-device temperature detected by temperature detection means. In addition, the display apparatus is configured such that the waveforms can be adjusted with external adjustment means from the outside of the apparatus.

The external adjustment means is configured such that it can be operated by the user and the settings of the external adjustment means are frequently reflected to the control of the display device, thereby allowing the display device to be adjusted by the user with good response.

The fluctuation of the contrast of the display device caused by changes in the waveforms of driving signals are larger than that generated when the voltage $V_{op}$ for the driving signals and the horizontal scanning period 1H are changed. Therefore when the waveforms of the driving signals frequently change with the external adjustment means, the display contrast largely changes accordingly, affecting adversely to image quality.

This embodiment solves this problem. Its object is to provide a high-performance display apparatus in which the adjustment of the driving conditions from the outside of the apparatus with an external adjustment means does not adversely affect the quality of an image.

The foregoing object is achieved according to this embodiment through the provision of a display apparatus in which the driving conditions used by control means in controlling the apparatus include the voltages, the scanning periods, and the waveforms of driving signals for the display device, and an external adjustment means externally adjusts the driving conditions other than the waveforms of the driving signals.

With the display apparatus configured as described above, the waveforms of the driving signals do not change even when the external adjustment means adjusts driving conditions frequently, not generating steep fluctuation of the display contrast due to changes in the waveforms.

The embodiment will be described below in detail by referring to the drawings.

Figure 15:
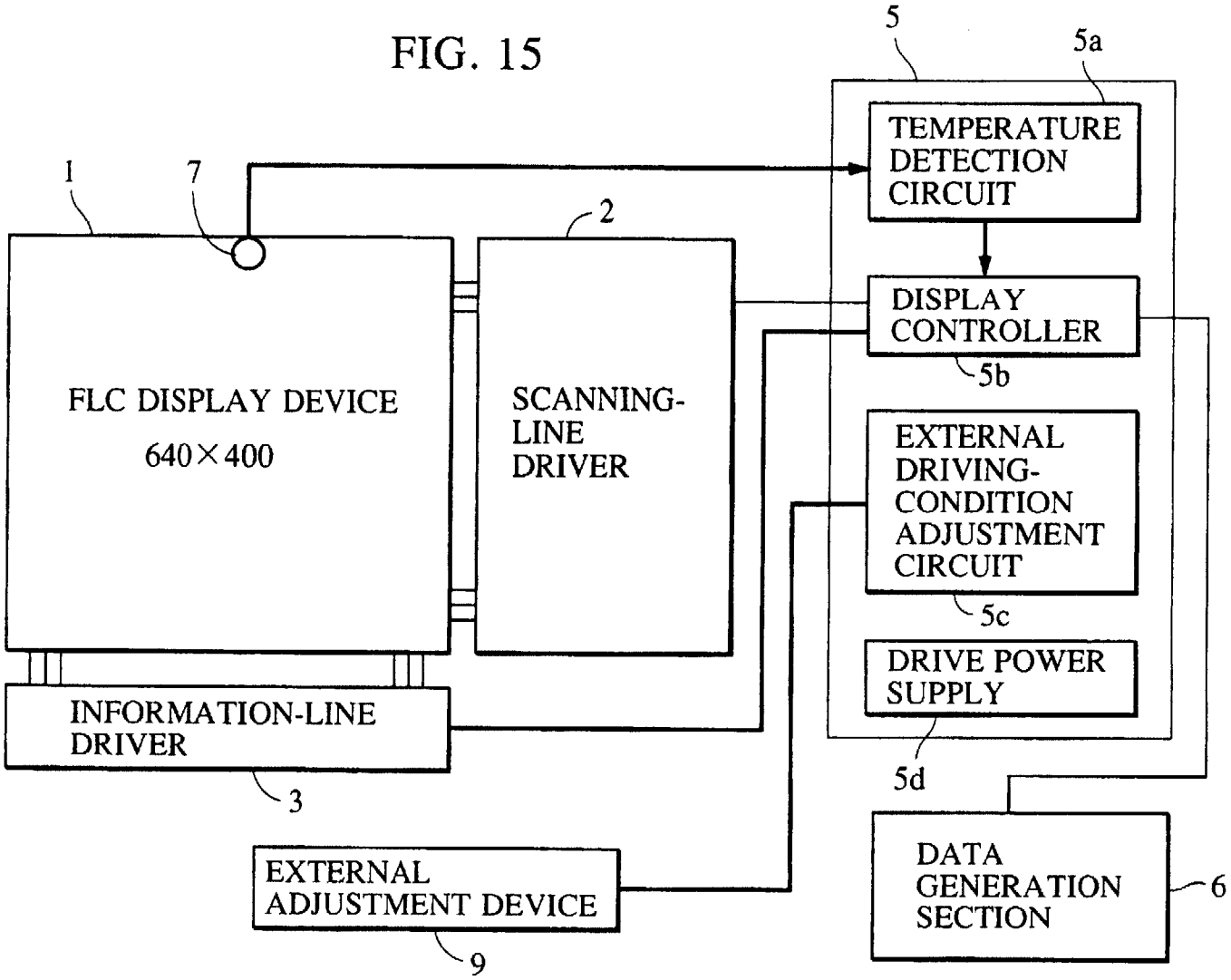
FIG. 15 is a block diagram of another display apparatus using the liquid crystal according to the present invention.

FIG. 15 is a block diagram of the control system of a display apparatus according to the embodiment of the present invention.

As shown in FIG. 15, the display apparatus comprises a ferroelectric liquid crystal (FLC) display device 1, a scanning line driver 2 and an information line driver 3 both of which drive the display device 1, a control unit 5 controlling the display device 1 by sending a scanning signal and an information signal both serving as driving signals for the drivers 2 and 3, respectively, a data generation section 6 for providing the control unit 5 with display data, a temperature sensor 7 for detecting the temperature of the FLC display device 1, and an external adjustment device 9 for externally adjusting driving conditions.

The FLC display device 1 displays data with dots of 640 by 400, for example. The liquid crystal material used is a mixture with main compositions of biphenyl liquid crystal compound and a phenylpyrimidine liquid crystal compound. The phase transition temperatures of the material are as follows:

$$\text{Crystal} \xrightarrow[-10^\circ\text{C.}]{} \text{SmC} \xrightarrow[63^\circ\text{C.}]{} \text{SmA} \xrightarrow[72^\circ\text{C.}]{} \text{Ch} \xrightarrow[91^\circ\text{C.}]{} \text{I}_{so}$$

The control unit 5 includes a temperature detection circuit 5*a*, a display controller 5*b*, an external driving-condition adjustment circuit 5*c*, and a drive power supply 5*d*. The control unit 5 controls the FLC display device 1 according to the display data supplied from the data generation section 6 and the driving conditions. The driving condition comprises the voltages, the scanning period, and the waveforms of the driving signals for the display device 1. The control unit 5 compensates for the temperature of the FLC display device 1 by referring to the temperature data detected by the temperature sensor 7 and the driving condition adjustment data controlled by the external adjustment data.

The external adjustment device 9 is a device such as a control and a digital switch with which the user can adjust the driving conditions from the outside of the apparatus. The driving condition adjustment data is made with an offset of ±5° C. against the temperature data detected by the temperature sensor 7. The external adjustment device 9 can adjust all driving conditions which the control unit 5 uses for control, other than the waveforms of the driving signals.

FIG. 9 shows the optimum driving conditions for the voltage $V_{op}$ and the horizontal scanning period 1H of the driving signals at each temperature of the FLC display device 1.

As shown in this figure, the control unit 5 changes the voltage $V_{op}$ and the horizontal scanning period 1H of the driving signals according to the temperature of the FLC display device 1. The unit 5 also supplies the driving signals (shown in FIG. 1) having relatively short pulses in a horizontal scanning period of 1H at a boundary temperature, for example, 20° C., or more, and the driving signals (shown in FIG. 5) having relatively long pulses in a horizontal scanning period of 1H at a temperature less than 20° C. to the scanning-line driver 2 and the information-line driver 3 to control the display device 1. With this condition, the FLC display device 1 is compensated for its temperature in a wide temperature range.

The control unit 5 refers to the temperature data detected by the temperature sensor 7 less frequently than the unit 5 refers to the driving condition adjustment data controlled by the external adjustment device 9. The temperature data is referenced once per minute, for example, and the driving condition adjustment data is referenced ten times per second. This means that the driving conditions are adjusted coarsely with the temperature sensor 7 and the user can fine-tune the driving conditions with good response by operating the external adjustment device 9.

Since the waveforms of the driving signals are not adjusted by the external adjustment device 9, the driving signals are not switched even when the user operates the external adjustment device 9. Therefore, the steep fluctuation of the display contrast caused by changes in the waveforms of the driving signal does not occur, thereby the FLC display device 1 maintains satisfactory image quality even when the user operates the external adjustment device 9.

(Third embodiment)

A third embodiment describes a driving method for a liquid crystal device in which a chiralsmectic liquid crystal is filled between one pair of substrates on which information-signal electrode groups and scanning-signal electrode groups are formed. In the driving method, the liquid crystal device is driven with a scanning signal being applied to the scanning-signal electrode groups and an information signal being applied to the information-signal electrode groups. Within the one-line address period of the scanning signal, driving signals applied to the liquid crystal have waveforms including no-voltage-applied periods when the liquid crystal shows the specific layer structure.

The scan selection signal applied to the scanning-signal electrode groups comprises a selection pulse, a deletion pulse disposed immediately before the selection pulse, and an auxiliary pulse disposed immediately after the selection pulse. The information signal applied to the information-signal electrode groups comprises a selection pulse, auxiliary pulses disposed before and after the selection pulse, and a rest period disposed before the first auxiliary pulse or after the second auxiliary pulse.

This chiralsmectic liquid crystal has a chevron layer structure in a cross section. The tilt angle $\delta$ of the smectic layer against the normal line for the substrates, which is a feature of the chevron structure of the chiralsmectic liquid crystal, decreases as the temperature lowers from a room temperature to a lower temperature. A temperature detection device for detecting the temperature of the liquid crystal device is provided. Only when the temperature of the liquid crystal is equal to (in other words, the layer inclination angle $\delta$ of the smectic layer against the normal line for the substrates is equal to the specified angle $\delta_0$) or less than the specified temperature, the information signal has a waveform including a no-voltage-applied period (rest period). When the temperature of the liquid crystal exceeds the specified temperature, the information signal which has a waveform including no no-voltage-applied period is used.

In this embodiment, the liquid crystal having the following properties at 30° C. and pre-tilt angle should be used.

Pre-tilt angle: 18 degrees

Tilt angle: 13 degrees

Layer inclination angle: 11 degrees

Phase transition temperature: Iso 92° C. Ch 85° C. SmA 67° C. SmC −17° C. Crystal (temperature lowering process)

This liquid crystal composition is a liquid crystal compound having phenylpyrimidine as the main component, combined with a fluorine compound serving as a chiral additive.

In this liquid crystal, the C2 state appears very frequently at a low temperature range (for example, from 5° C. to 20° C.) in a practical temperature zone. Therefore, it is important to suppress the occurrence of the C2 state with the use of the waveforms of the driving signals at a low temperature range. It is considered that the reason why the C2 state tends to appear at a low temperature is that the transition energy between the C1 and C2 states decreases as the layer inclination angle $\delta$ becomes small at a lower temperature. Therefore, signals having first waveforms which include rest (no-voltage-applied) periods are used at a low temperature range in which the tilt angle of the smectic layer is equal to or less than the specified value $\delta_0$, and signals having second waveforms which does not include rest periods and provide fast drawing by the time saved by eliminating the rest periods at a high temperature range in which the layer inclination angle exceeds $\delta_0$. Typical examples of the first waveforms are shown in FIG. 5 and those of the second waveforms are shown in FIG. 1.

When the liquid crystal is used for applications which do not require a high drawing speed, signals having the waveforms which include rest periods in the whole temperature range may be used by setting $\delta_0$ to an angle for a high temperature.

According to the present invention, providing a no-electric-field period in one-line address period for each driving signal improves the alignment characteristics of the liquid crystal, increases production stability, and offers a high-quality liquid crystal display. The structure of a liquid crystal device according to the present embodiment is the same as that shown in FIGS. 12 to 14.

In this embodiment, when the liquid crystal is driven with the signals having no reset period shown in FIG. 1, the C2 state may appear very frequently or the C2 state area may become large.

Stable, satisfactory images without the C2 structure can be obtained by setting $\delta_0$ shown in FIG. 7 to 9 degrees and by driving the liquid crystal with signals having waveforms which include rest periods at 20° C. or less and with signals having waveforms which do not include rest periods at a temperature exceeding 20° C.

According to the present invention described above, satisfactory display is provided at a wide range of temperatures. Especially, crosstalks or alignment defects do not occur at a low temperature and the scanning speed does not decrease at a high temperature.

What is claimed is:

1. A driving method for a liquid crystal device in which a smectic liquid crystal and matrix electrodes comprising scanning electrode groups and information electrode groups are disposed, wherein the waveforms of driving signals applied to the matrix electrodes are changed according to the temperature of the device, and wherein an electric field is always applied to the liquid crystal when the temperature of the liquid crystal device falls within a high temperature range, and a period in which an electric field is not applied to the liquid crystal is provided when the temperature of the liquid crystal device falls within a lower temperature range than the high temperature range, and the period in which an electric field is not applied is selectively provided when the temperature of the liquid crystal falls outside of either the high temperature range or the lower temperature range.

2. A driving method according to claim 1, wherein a selection period changes between when the liquid crystal device has a high temperature and when the liquid crystal device has a low temperature.

3. A driving method according to claim 1, wherein among the driving signals, a scan selection signal applied to the scanning electrode groups comprises:

a selection pulse;

an erasing pulse disposed immediately before the selection pulse; and an auxiliary pulse disposed immediately after the selection pulse irrespective of the temperature, and an information signal applied to the information electrode groups comprises at a high temperature:

a selection pulse; and auxiliary pulses disposed before and after the selection pulse, and comprises at a low temperature:

a selection pulse;

auxiliary pulses disposed before and after the selection pulse; and the period in which an electric field is not applied provided between the two auxiliary pulses so as not to continue the auxiliary pulses.

4. A driving method according to claim 1, wherein a horizontal scanning period and applied voltages are changed according to temperature conditions.

5. A driving method according to claim 4, wherein the horizontal scanning period and the applied voltages are changed according to settings controlled by external adjustment means, and the waveforms of the driving signals do not depend on the settings.

6. A driving method according to claim 1, wherein the high temperature range is from 20° C. to 40° C. and the low temperature range is from 0° C. to 10° C.

7. A driving method for a liquid crystal device in which a smectic liquid crystal and matrix electrodes comprising scanning electrode groups and information electrode groups are disposed, wherein the waveforms of driving signals applied to the scanning electrode groups and the information electrode groups are changed according to the temperature of the device, and wherein an electric field is always applied to said liquid crystal when the liquid crystal device has a high temperature, and a period in which an electric field is not applied to the liquid crystal is provided when the liquid crystal device has a low temperature.

8. A driving method according to claim 7, wherein the high temperature is a range from 20° C. to 40° C. and the low temperature is a range from 0° C. to 10° C.

9. A liquid crystal apparatus in which a liquid crystal device in which a smectic liquid crystal is filled between one pair of substrates on which information-signal electrode groups and scanning-signal electrode groups are formed is driven by applying a scan selection signal to said scanning-signal electrode groups and an information signal to said information-signal electrode groups, wherein a temperature detection device for detecting a temperature of said liquid crystal is provided, and wherein driving signals applied to said liquid crystal have waveforms including no-voltage-applied periods within one-line address period of said scanning signal when said liquid crystal shows a specific layer structure, and are used only when the temperature of said liquid crystal device is equal to or less than a specified temperature and said driving signals having none of said no-voltage-applied period are used when the temperature of said liquid crystal device exceeds said specified temperature.

10. A liquid crystal apparatus according to claim 9, wherein, among said driving signals, said scan selection signal applied to said scanning-signal electrode groups comprises:

a selection pulse;

an erasing pulse disposed immediately before said selection pulse; and an auxiliary pulse disposed immediately after said selection pulse, and said information signal applied to said information-signal electrode groups comprises:

a selection pulse;

auxiliary pulses disposed before and after said selection pulse; and a no-voltage-applied period disposed before the first auxiliary pulse or after the second auxiliary pulse.

11. A liquid crystal apparatus in which a liquid crystal device in which a smectic liquid crystal is filled between one pair of substrates on which information-signal electrode groups and scanning-signal electrode groups are formed is driven by applying a scan selection signal to said scanning-signal electrode groups and an information signal to said information-signal electrode groups, wherein driving signals applied to said liquid crystal have waveforms including no-voltage-applied periods within a one-line address period of said scanning signal when said liquid crystal shows a specific layer structure, and wherein a temperature detection device for detecting the temperature of said liquid crystal device is provided, and said driving signals having said no-voltage-applied periods are used only when the temperature of said liquid crystal device is equal to or less than a specified temperature and said driving signals having none of said no-voltage-applied periods are used when the temperature of said liquid crystal device exceeds said specified temperature.

12. A liquid crystal apparatus in which a liquid crystal device in which a smectic liquid crystal is filled between one pair of substrates on which information-signal electrode groups and scanning-signal electrode groups are formed is driven by applying a scan selection signal to said scanning-signal electrode groups and an information signal to said information-signal electrode groups, wherein driving signals applied to said liquid crystal have waveforms including no-voltage-applied periods within one-line address period of said scanning signal when said liquid crystal shows a specific layer structure, wherein, among said driving signals, said scan selection signal applied to said scanning-signal electrode groups comprises:

a selection pulse;

an erasing pulse disposed immediately before said selection pulse; and an auxiliary pulse disposed immediately after said selection pulse, and said information signal applied to said information-signal electrode groups comprises:

a selection pulse;

auxiliary pulses disposed before and after said selection pulse; and a rest period disposed before the first auxiliary pulse or after the second auxiliary pulse, and wherein a temperature detection device for detecting the temperature of said liquid crystal device is provided, and said information signal having said rest period is used only when the temperature of said liquid crystal device is equal to or less than a predetermined temperature and said information signal from which said rest period is eliminated is used when the temperature of said liquid crystal device exceeds said predetermined temperature.

13. A liquid crystal apparatus according to any one of claims 9 to 12, wherein said liquid crystal is a chiral smectic liquid crystal.

14. A liquid crystal apparatus according to claim 9, wherein said smectic liquid crystal has a chevron structure in its cross section, a tilt angle $\delta$ of a smectic layer against a normal line for said substrates, which is a feature of said chevron structure of said smectic liquid crystal, decreases as the temperature lowers from a room temperature to a lower temperature, and the specified temperature is the temperature at which the tilt angle $\delta$ equals a specific angle $\delta_o$.

15. A liquid crystal apparatus comprising:

a liquid crystal device;

a driver for scanning and driving said device;

a controller for controlling said device through said driver;

a display-data generator for generating display data;

a temperature detector for detecting the temperature; and an external adjuster for externally adjusting driving conditions and being configured such that said device is driven according to the temperature by referring to detection data obtained by said temperature detector and driving-condition adjustment data controlled by said external adjuster when said controller controls said device based on said display data created by said display-data generator and the driving conditions, wherein the driving conditions used by said controller for controlling include the voltages, scanning periods, and waveforms of driving signals for driving said device, and said external adjuster adjusts the driving conditions excluding the waveforms of said driving signals, and wherein said waveforms always include no-voltage-applied periods when the temperature falls within a specified low temperature range, said waveforms include none of the no-voltage-applied periods when the temperature falls within a specified high temperature range, and said waveforms selectively include no-voltage-periods when the temperature falls outside of the low temperature range and the high temperature range.

16. A liquid crystal apparatus according to claim 15, wherein said controller refers to said detection data obtained by said temperature detector less frequently than said controller refers to said driving-condition adjustment data controlled by said external adjuster.

17. A liquid crystal apparatus according to claim 15 or 16, wherein said external adjuster uses said detection temperature data obtained by said temperature detector with a constant amount of offset as driving-condition adjustment data.

18. A liquid crystal apparatus according to claim 15 or 16, wherein said device is composed of a ferroelectric liquid crystal.

19. An apparatus according to claim 15, wherein the high temperature range is from 20° C. to 40° C. and the low temperature range is from 0° C. to 10° C.

* * * * *

UNITED STATES PATENT AND TRADEMARK OFFICE

CERTIFICATE OF CORRECTION

PATENT NO. : 5,796,381

DATED : August 18, 1998

INVENTOR(S): MANABU IWASAKI ET AL.

It is certified that error appears in the above-identified patent and that said Letters Patent is hereby corrected as shown below:

ON THE TITLE PAGE AT [56] References Cited
FOREIGN PATENT DOCUMENTS, "02281233" should read --2-281233--.

SHEET 6
Fig. 7, "NERA" should read --NEAR--.

SHEET 11
Fig. 12, "CETECTION" should read --DETECTION--.

COLUMN 1
Line 58, "tend" should read --tends--.

COLUMN 4
Line 17, "There is" should read --There are--;
Line 21, "shows" should read --show--;
Line 53, "assures" should read --assure--;
Line 55, "enables" should read --enable--;
Line 59, "has a" should read --have a--.

COLUMN 5
Line 21, "fluctuates" should read --fluctuate--;
Line 22, "fluctuates" should read --fluctuate--;
Line 46, "show" should be deleted.

COLUMN 6
Line 18, "have" should read --has--.

UNITED STATES PATENT AND TRADEMARK OFFICE

CERTIFICATE OF CORRECTION

PATENT NO. : 5,796,381

DATED : August 18, 1998

INVENTOR(S): MANABU IWASAKI ET AL.

It is certified that error appears in the above-identified patent and that said Letters Patent is hereby corrected as shown below:

COLUMN 7,
Line 34, "Proving" should read --Providing--.

COLUMN 8
Line 43, "lines" should read --line--.

COLUMN 9
Line 26, "is also" should read --are also--.

UNITED STATES PATENT AND TRADEMARK OFFICE

CERTIFICATE OF CORRECTION

PATENT NO. : 5,796,381

DATED : August 18, 1998

INVENTOR(S): MANABU IWASAKI ET AL.

It is certified that error appears in the above-identified patent and that said Letters Patent is hereby corrected as shown below:

COLUMN 10

Table 1, "

TABLE 1

| | | | | |
|---|---|---|---|---|
| $P_s$ | | 6.1 nC/cm$^2$ (30°C.) | | |
| Tilt angle | | 14.6° (30°C.) | | |
| $\Delta\epsilon$ | | -0.2 (30°C.) | | |
| | 91.5°C. → | 85.0°C. → | 66.7°C. → | -16.7°C. → |
| $I_{so}$ | Ch | SmA | SmC* | Crystal |
| | 91.8°C. ← | 85.7°C. ← | ← | -12.5°C. ← |

"

should read --

TABLE 1

| | | | | |
|---|---|---|---|---|
| $P_s$ | | 6.1 nC/cm$^2$ (30°C) | | |
| Tilt angle | | 14.6° (30°C) | | |
| $\Delta\epsilon$ | | -0.2 (30°C) | | |
| | 91.5°C → | 85.0°C → | 66.7°C → | -16.7°C → |
| $I_{so}$ | Ch | SmA | SmC* | Crystal |
| | 91.8°C ← | 85.7°C ← | ← | -12.5°C ← |

--

UNITED STATES PATENT AND TRADEMARK OFFICE

CERTIFICATE OF CORRECTION

PATENT NO. : 5,796,381

DATED : August 18, 1998

INVENTOR(S): MANABU IWASAKI ET AL.

It is certified that error appears in the above-identified patent and that said Letters Patent is hereby corrected as shown below:

COLUMN 13

Line 64, "does not" should read --do not--.

Signed and Sealed this

Eleventh Day of May, 1999

*Attest:*

Q. TODD DICKINSON

*Attesting Officer*

*Acting Commissioner of Patents and Trademarks*